US005324030A

United States Patent [19]

Tsou

[11] Patent Number: 5,324,030

[45] Date of Patent: Jun. 28, 1994

[54] SHOCK ABSORBING THROATPIECE OF GAME RACKET

[76] Inventor: Ching-Fang Tsou, No. 92, Yung Kang Rd., Feng Yuan City, Taichung Hsien, Taiwan

[21] Appl. No.: 54,030

[22] Filed: Apr. 29, 1993

[51] Int. Cl.[5] ..... A63B 49/02

[52] U.S. Cl. ..... 273/73 G

[58] Field of Search ..... 273/73 R, 73 C, 73 D, 273/73 E, 73 G, 73 F

[56] References Cited

U.S. PATENT DOCUMENTS

| | | | |
|---|---|---|---|
| 3,908,995 | 9/1975 | Portz | 273/73 G |
| 4,057,250 | 11/1977 | Kuban | 273/73 G |
| 4,600,194 | 7/1986 | Donnelly | 273/73 G |
| 4,634,124 | 1/1987 | Yuhas et al. | 273/73 G |
| 5,155,896 | 10/1992 | Pai | 273/73 G X |
| 5,174,568 | 12/1992 | You | 273/73 F |
| 5,178,386 | 1/1993 | Tzeng | 273/73 G |
| 5,217,223 | 6/1993 | Feeney | 273/73 G X |

FOREIGN PATENT DOCUMENTS

| | | | |
|---|---|---|---|
| 568037 | 12/1923 | France | 273/73 G |

*Primary Examiner*—William E. Stoll

*Attorney, Agent, or Firm*—Browdy and Neimark

[57] ABSTRACT

A game racket comprises a head frame, a handle, and a triangular throatpiece located between the head frame and the handle. The triangular throatpiece comprises a space defined by three side frames making up the triangular throatpiece. A shock-absorbing member of a geometric shape is disposed in the space of the triangular throatpiece. The shock-absorbing member is fastened at three points with the three side frames of the triangular throatpiece, so as to enable the shock waves to travel from the head frame to reach the shock-absorbing member in which the shock waves are cancelled out at the geometric center of the shock-absorbing member.

3 Claims, 2 Drawing Sheets

SHOCK ABSORBING THROATPIECE OF GAME RACKET

FIELD OF THE INVENTION

The present invention relates to a game racket, and more particularly to a shock-absorbing throatpiece of the game racket.

BACKGROUND OF THE INVENTION

There are several kinds of game rackets, such as tennis rackets, squash rackets, badminton rackets, etc., which may be made of composite, or aluminium or wooden material. In general, a game racket has an inverted triangular throatpiece located between the head and the handle of the game racket.

A game racket of carbon composite material or aluminium alloy material is known for its lightweight quality and high rigidity. The high structural rigidity of the game racket is generally responsible for a rapid transmission of the shock waves from the head to the handle and further to the hand holding the handle. As a result, the hand of the user of such game racket is vulnerable to injury. The most commonly used method of absorbing the shock waves is to use the shock-absorbing element which is disposed between the head frame and the head strings so as to mitigate the impact of the shock by making a direct contact with the head strings. Another commonly used method of absorbing the shock waves of the head strings is to provide the racket handle with a shock-absorbing means. Such prior art methods as described above are limited in that the shock waves are not effectively mitigated by the shock-absorbing element so disposed as to make a direct contact with the head strings, and that the structure and the construction of the racket frame is made rather complicated by the shock-absorbing means disposed in the head frame or the handle.

SUMMARY OF THE INVENTION

It is therefore the primary objective of the present invention to provide a game racket with a triangular throatpiece having a shock-absorbing means.

It is another objective of the present invention to provide a game racket with a shock-absorbing throatpiece such that the structural integrity and the external form of the head frame and the handle of the game racket are not undermined.

It is still another objective of the present invention to provide a game racket with a shock-absorbing throatpiece which reinforces the structural strength of the game racket.

The foregoing objectives of the present invention are attained by a shock-absorbing triangular throatpiece, which is disposed between a head frame and a handle of the game racket and which is composed of a space defined by three support frames making up the shock-absorbing triangular throatpiece. The space is provided therein with a shock-absorbing means having a geometric shape, such as a Y shape, or a delta shape, or an oval shape. The shock-absorbing means are fastened respectively at three points to the three support frames of the triangular throatpiece, with three distances between the geometric center of the shock-absorbing means and the three support frames being equal. The shock waves, which originate in the head frame, are transmitted to the three support frames of the triangular throatpiece and then on to the shock-absorbing means. The shock waves so transmitted are then cancelled out at the geometric center of the shock-absorbing means. As a result, the shock waves are prevented from traveling to the handle.

DETAILED DESCRIPTION OF THE INVENTION

Figure 1:
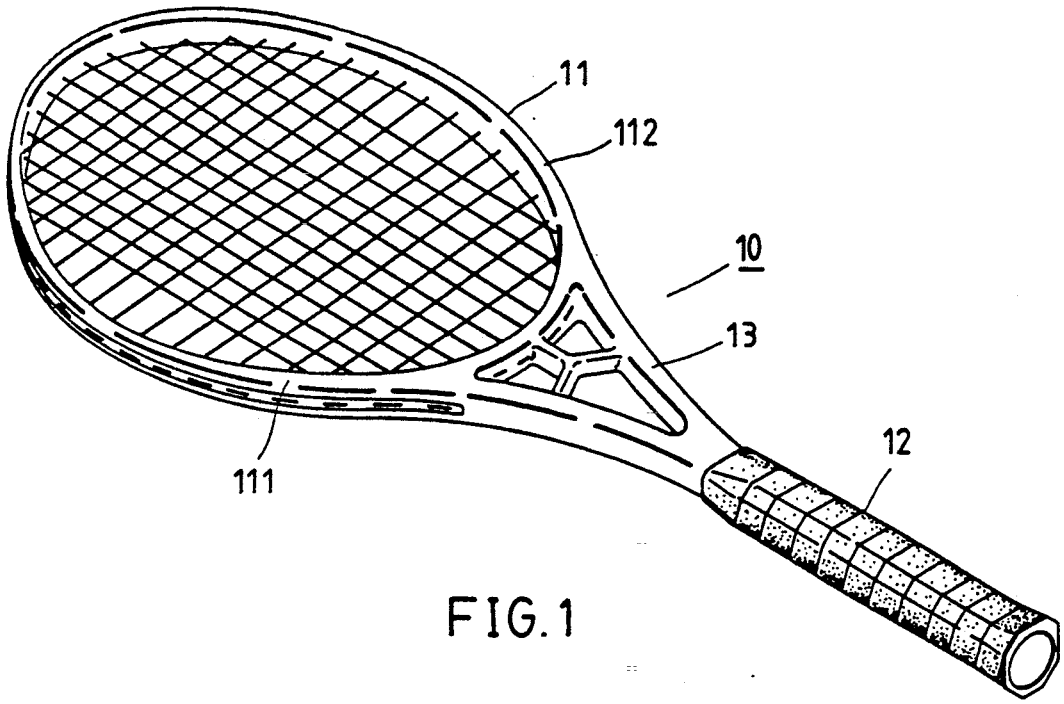
FIG. 1 shows a perspective view of a game racket provided with a shock-absorbing triangular throatpiece of the present invention.

Referring to FIG. 1, a game racket 10 of the present invention has a triangular throatpiece 13, which is located between a head frame 11 and a handle 12 of the game racket 10 and is composed of three support frames 131, 132 and 133. The triangular throatpiece 13 of the present invention is provided with a shock-absorbing member 15 of Y-shaped construction. The shock-absorbing member 15 has three ribs 151, 152 and 153, which are about equal in length. The inner ends of the three ribs 151, 152 and 153 meet at a central shock-absorbing point P while the outer ends of the three ribs 151, 152 and 153 are fastened respectively at points P1, P2 and P3 with the three support frames 131, 132 and 133. In other words, the three distances between the central shock-absorbing point P and the points Pl, P2 and P3 are about equal. If the game racket 10 of the present invention is made of carbon fiber reinforced material, the shock-absorbing member 15 of the present invention is made integral and unitary with the game racket 10 by using a carbon fiber tube which is wound around the support frames 131, 132 and 133 before being heated in a molding tool. The shock-absorbing member 15 is fastened securely in the triangular throatpiece 13. Such manufacturing process as described above is not different from the conventional method of making a game racket of carbon fiber material. Therefore, the manufacture of the present invention does not call for any additional expenditure of working capital.

Figure 2:
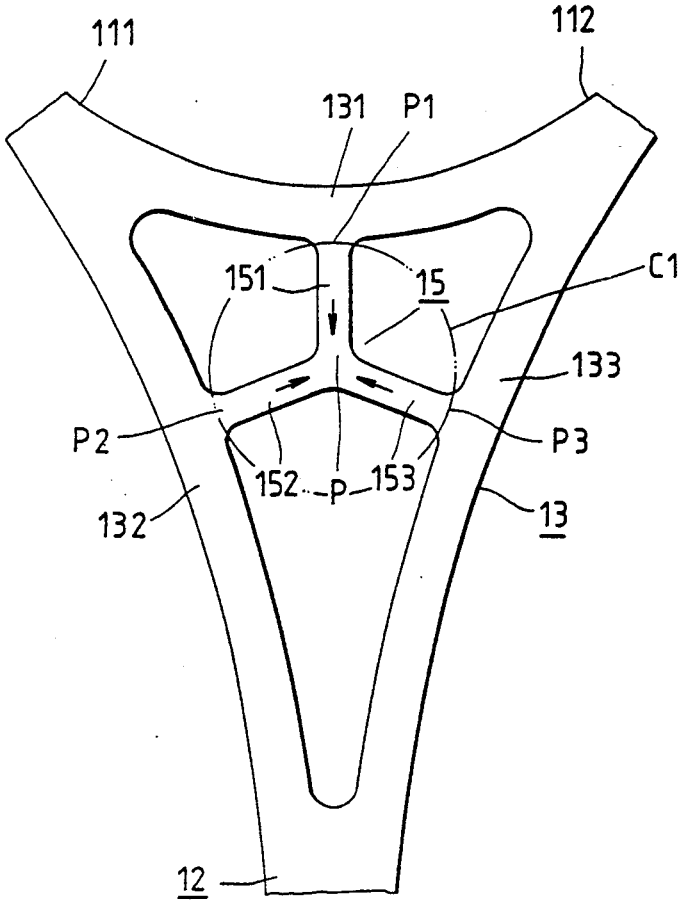
FIG. 2 is a schematic view illustrating the way that the shock waves are absorbed by the triangular throatpiece as shown in FIG. 1.

As shown in FIG. 2, the contact points P1, P2 and P3 between the triangular throatpiece 13 and the shock-absorbing member 15 are all located on the circumference C1 of a circle with the shock-absorbing point P being its center. Upon hitting a ball, the strings of the head frame 11 are impacted to generate the shock waves, which are immediately transmitted to the support frame 131 of the triangular throatpiece 13 and to the support frames 132 and 133 of the triangular throatpiece 13 via side frames 111 and 112 of the head frame 11. The shock waves so transmitted to the support frames 131, 132 and 133 of the triangular throatpiece 13 are then transmitted via ribs 151, 152 and 153 to the shock-absorbing point P where the shock waves are cancelled out.

The shock-absorbing member 15 of the present invention serves the dual purposes of attenuating the shock waves transmitted from the head frame and of reinforcing the structural strength of the throatpiece of the game racket. Moreover, the construction of the shock-absorbing member 15 gives an added uniqueness to the overall appearance of the game racket.

Figure 3:
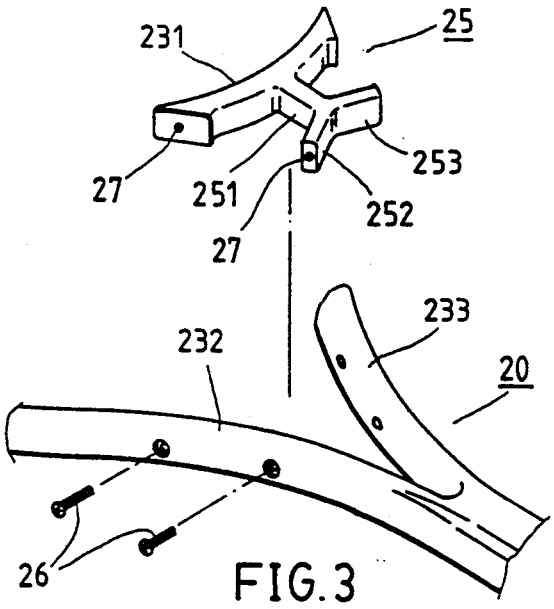
FIG. 3 shows an exploded view of a shock-absorbing triangular throatpiece of a second preferred embodiment of the present invention.
Figure 4:
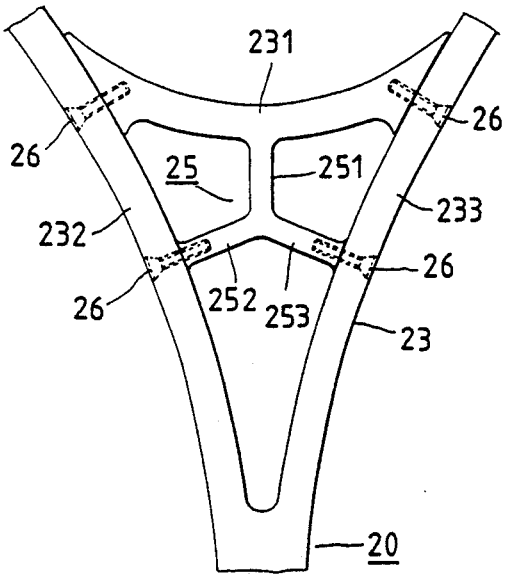
FIG. 4 shows a schematic view of the shock-absorbing triangular throatpiece of the second preferred embodiment in combination, as shown in FIG. 3.

As shown in FIGS. 3 and 4 illustrating another embodiment of the present invention, a shock-absorbing member 25 may be fastened to a throatpiece 23 of a game racket 20 of aluminium material. The shock-absorbing member 25 of the second preferred embodiment of the present invention is different from the shock-absorbing member 15 of the first preferred embodiment of the present invention in that the former has three ribs 251, 252 and 253 which are made of plastic material by injection molding, and that the former is fastened to the support frames 232 and 233 of the throatpiece 23 by means of four screws 26 engageable with four threaded holes 27 disposed in the support frame 231 and the two ribs 252 and 253 of the shock-absorbing member 25.

Figure 5:
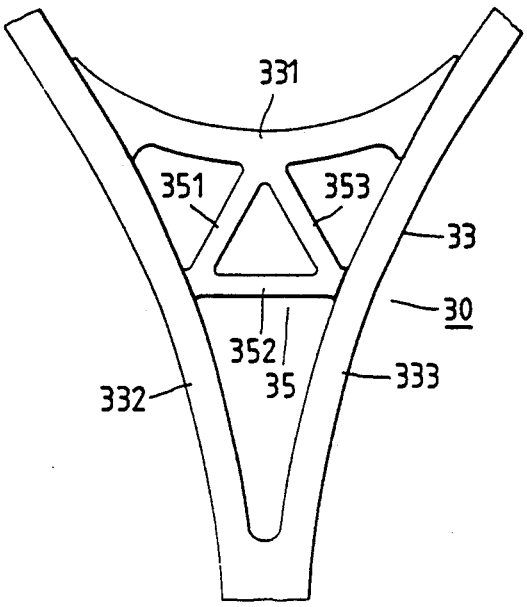
FIG. 5 shows a schematic view of a shock-absorbing triangular throatpiece of a third preferred embodiment of the present invention.

A third preferred embodiment of the present invention is illustrated in FIG. 5, in which a throatpiece 33 of a game racket 30 is shown to comprise a shock-absorbing member 35 of a delta shape. The shock-absorbing member 35 is composed of three ribs 351, 352 and 353, which are fastened respectively with three support frames 331, 332 and 333. The shock-absorbing member 35 may be made integrally with the game racket 30, or made of plastic material by injection molding separately and then fastened to the throatpiece 33. Upon hitting a ball, the strings of the game racket 30 are so impacted as to generate the shock waves, which are transmitted to the three ribs 351, 352 and 353 of the shock-absorbing member 35 where the shock waves are cancelled out. In addition, the shock-absorbing member 35 serves the purpose of reinforcing the structural strength of the throatpiece 33 of the game racket 30.

The embodiments of the present invention described above are to be regarded in all respects as merely illustrative and not restrictive. Accordingly, the present invention may be embodied in other specific forms without deviating from the spirit thereof. For example, the shock-absorbing member of the present invention may be of any shape formed by straight ribs or arcuate ribs. Therefore, the present invention is to be limited only by the scope of the following appended claims.

What is claimed is:

1. In a game racket frame having a head frame and a handle connected by an inverted triangular throatpiece formed by a lower portion of said head and a pair of support frame sections meeting adjacent an upper portion of said handle, the improvement comprising:

a fiber reinforced material shock-absorbing means for providing a shock-absorbing effect, for improving structural integrity of said inverted triangular throatpiece, for reinforcing the structural strength of said game racket, and for enabling shock waves from said head frame to travel via said support frame sections to reach said shock-absorbing means in which the shock waves are cancelled out, said shock-absorbing means comprising an inverted generally Y-shaped member formed of three ribs meeting at a central shock absorbing point lying in a longitudinal axis passing through the center of said handle, said three ribs being integrally joined at said central shock absorbing point, two of said ribs being respectively joined at ends distal from said central shock absorbing point to said support frame sections and a third of said ribs extending along said axis and being integrally joined to said lower portion of said head frame, and said inverted Y-shaped member being integral and unitary with said inverted triangular throatpiece.

2. A game racket frame in accordance with claim 1, formed of fiber reinforced material.

3. A game racket frame in accordance with claim 2, wherein said fiber is carbon fiber.

* * * * *